US006109988A

United States Patent [19]

Dunn, Jr.

[11] Patent Number: 6,109,988

[45] Date of Patent: Aug. 29, 2000

[54] MECHANISM FOR ROWING A SMALL BOAT

[76] Inventor: Edward D. Dunn, Jr., Rte. 1, Box 122, Morgan, Ga. 31766

[21] Appl. No.: 09/286,961

[22] Filed: Apr. 6, 1999

[51] Int. Cl.[7] ..... B63H 16/10

[52] U.S. Cl. ..... 440/104; 440/25; 440/106

[58] Field of Search ..... 440/21, 25, 104, 440/105, 106, 107, 108, 109; 114/363

[56] References Cited

U.S. PATENT DOCUMENTS

| | | | |
|---|---|---|---|
| 183,265 | 10/1976 | Isaacs, Jr. | 440/105 |
| 184,031 | 11/1876 | Blakeman, Jr. | 440/105 |
| 185,032 | 12/1876 | Isaacs, Jr. . | |
| 578,815 | 3/1897 | Fryer . | |
| 3,729,369 | 4/1973 | Trull . | |
| 4,383,830 | 5/1983 | Cartwright . | |
| 4,623,314 | 11/1986 | Waugh . | |
| 4,649,852 | 3/1987 | Piantedosi . | |
| 5,215,482 | 6/1993 | Heary . | |
| 5,248,272 | 9/1993 | duPont . | |
| 5,647,782 | 7/1997 | Henry . | |
| 5,685,750 | 11/1997 | Rantilla . | |

*Primary Examiner*—Sherman Basinger
*Attorney, Agent, or Firm*—Hinkle & Associates, P.C.

[57] ABSTRACT

A new and improved leg assisted forward rowing system wherein a user can mechanically advantage the rowing of a boat by first pushing his foot forward along a foot glide member which is slidably engaged within a first track member. This force is transferred to the oar via a pulley belt system that engages both the foot sliding mechanism and an oar movement mechanism. The oar movement mechanism comprises an oar glide member that is forced by the pulley belt system to slide within a second track member in the opposite direction of the foot sliding mechanism. Attached to the oar glide member is an oar support mechanism in which the handle of an oar is received within an oar lock having a downwardly extending stem. The oar lock stem is slidably received by a stem support member that allows the stem to slide upward and downward therein. Additionally, the oar lock is dimensioned to allow movement of the oar handle; however, this movement may be controlled/restricted by the insertion of filler material (i.e., rubber, foam) within the oar lock. Moreover, the stem support member is attached to a triangular support member that is hinged to oar glide member. Thus, the freedom of movement of the oar creates a natural feel to the user, yet his rowing efforts are advantaged and more efficient. A mirror image arrangement is carried by the other side of the boat for receiving the user's other foot and thus advantaging his rowing efforts for the other oar.

13 Claims, 3 Drawing Sheets

MECHANISM FOR ROWING A SMALL BOAT

BACKGROUND OF THE INVENTION

I. Field of the Invention

The present invention relates generally to the field of boating and, more particularly, to a new and improved leg assisted rowing system.

II. Description of the Related Art

Rowing can be both a casual hobby or a competitive sporting event. Numerous designs have been proposed to improve and mechanically advantage such efforts, because of the well known and frequently acknowledged muscular and cardiovascular benefits of rowing, and also to further the social and sporting appeal of rowing.

However, many of the previous patents disclose rowing apparatus that do not adequately duplicate the rowing motion of conventional oars. For instance, conventional oar motion includes the ability to pivot the oars relative to the user and to rotate the oars such that the oar face is substantially parallel with the surface of the water. This latter motion, called feathering, is particularly desired in sport rowing to reduce the wind resistance on the return stroke, thus increasing the stroke efficiency. Examples of such limited motion devices may be found by reference to U.S. Pat. No. 185,032 to Isaacs, Jr., U.S. Pat. No. 3,729,369 to Trull, U.S. Pat. No. 4,623,314 to Waugh, U.S. Pat. No. 4,383,830 to Cartwright, U.S. Pat. No. 5,215,482 to Henry and U.S. Pat. No. 5,248,272 to duPont. Although the oar faces of Trull, Waugh and duPont may be rotated to allow feathering, their vertical and horizontal oar pivotability is limited and/or does not adequately represent the freedom of motion of conventional rowing.

In addition to the limitation in oar movement, most prior art devices do not provide a means for utilizing the force and motion of the user's legs to facilitate the power stroke and/or to assist in the return stroke. Although some designs do provide fixed feet support, this type of arrangement is disadvantageous. For instance, with fixed feet support, more stress is transferred to the user's back, and the force available from the user's legs is passive, thus reducing the added efficiency and limiting the physical benefits available from an active leg system. Examples of such systems may be found by reference to U.S. Pat. No. 3,729,369 to Trull, U.S. Pat. No. 4,649,852 to Piantedosi and U.S. Pat. No. 5,248,272 to duPont. Attempts have been made to improve the above discussed deficiencies; however, such attempts have disadvantages. Examples of such attempts may be found by reference to U.S. Pat. No. 5,647,782 to Henry and U.S. Pat. No. 5,685,750 to Rantilla. For instance, with Henry, the entire oar rigging, including the inboard and outboard rigging, is carried by the feet sliding mechanism. Therefore, this added weight must also be moved forward and backward with each stroke thus increasing the required force and effort of the user. With Rantilla, the pushing force applied by the feet can facilitate the power stroke; however, the return stroke is generally applied by a tension spring thereby making the leg application, generally, passive. Moreover, the freedom of movement of Rantilla is extremely limited thus reducing the feel and comfort of conventional rowing.

It is readily apparent that a new and improved leg assisted forward rowing system is needed to overcome the disadvantages just described. It is, therefore, to the provision of such an improved that the present invention is directed.

SUMMARY OF THE INVENTION

In accordance with the present invention and the contemplated problems which have and continue to exist in this field, a new and improved leg assisted forward rowing system is described wherein a user can mechanically advantage the rowing of a boat by first pushing his foot forward along a foot glide member which is slidably engaged within a first track member. This force is transferred to the oar via a pulley belt system that engages both the foot sliding mechanism and an oar movement mechanism. The oar movement mechanism comprises an oar glide member that is forced by the pulley belt system to slide within a second track member in the opposite direction of the foot sliding mechanism. Attached to the oar glide member is an oar support mechanism in which the handle of an oar is received within an oar lock having a downwardly extending stem. The oar lock stem is slidably received by a stem support member that allows the stem to slide upward and downward therein. Additionally, the oar lock is dimensioned to allow movement of the oar handle; however, this movement may be controlled/restricted by the insertion of filler material (i.e., rubber, foam) within the oar lock. Moreover, the stem support member is attached to a suitable support member that is hinged to oar glide member. Thus, the freedom of movement of the oar creates a natural feel to the user, yet his rowing efforts are advantaged and more efficient. A mirror image arrangement is carried by the other side of the boat for receiving the user's other foot and thus advantaging his rowing efforts for the other oar.

A feature and advantage of the present invention is to provide a new and improved leg assisted forward rowing system that has the freedom of movement of conventional rowing systems.

Further, the present invention provides a new and improved leg assisted forward rowing system having means for slidably engaging the feet of a user, wherein the legs of the user can be utilized to facilitate both the power stroke and the return stroke.

The present invention also provides a new and improved leg assisted forward rowing system having an oar movement mechanism, a foot glide mechanism and a force transfer mechanism, wherein said force transfer mechanism transfers the leg force applied to said foot glide mechanism to said oar movement mechanism to facilitate the rowing of a boat.

Yet, another feature and advantage of the present invention is to provide a new and improved leg assisted forward rowing system that transfers sufficient leg force to the power stroke to allow the reduction in oar length to achieve the same mechanical advantage thereby reducing the needed space for sporting row boats.

Additionally, the present invention provides a new and improved leg assisted forward rowing system that is simple to manufacture and can be easily adapted to a preexisting boat.

Other objects, advantages and capabilities of the invention will become apparent from the following description taken in conjunction with the accompanying drawings showing the preferred embodiment of the invention.

DESCRIPTION OF THE PREFERRED EMBODIMENT

Figure 1:
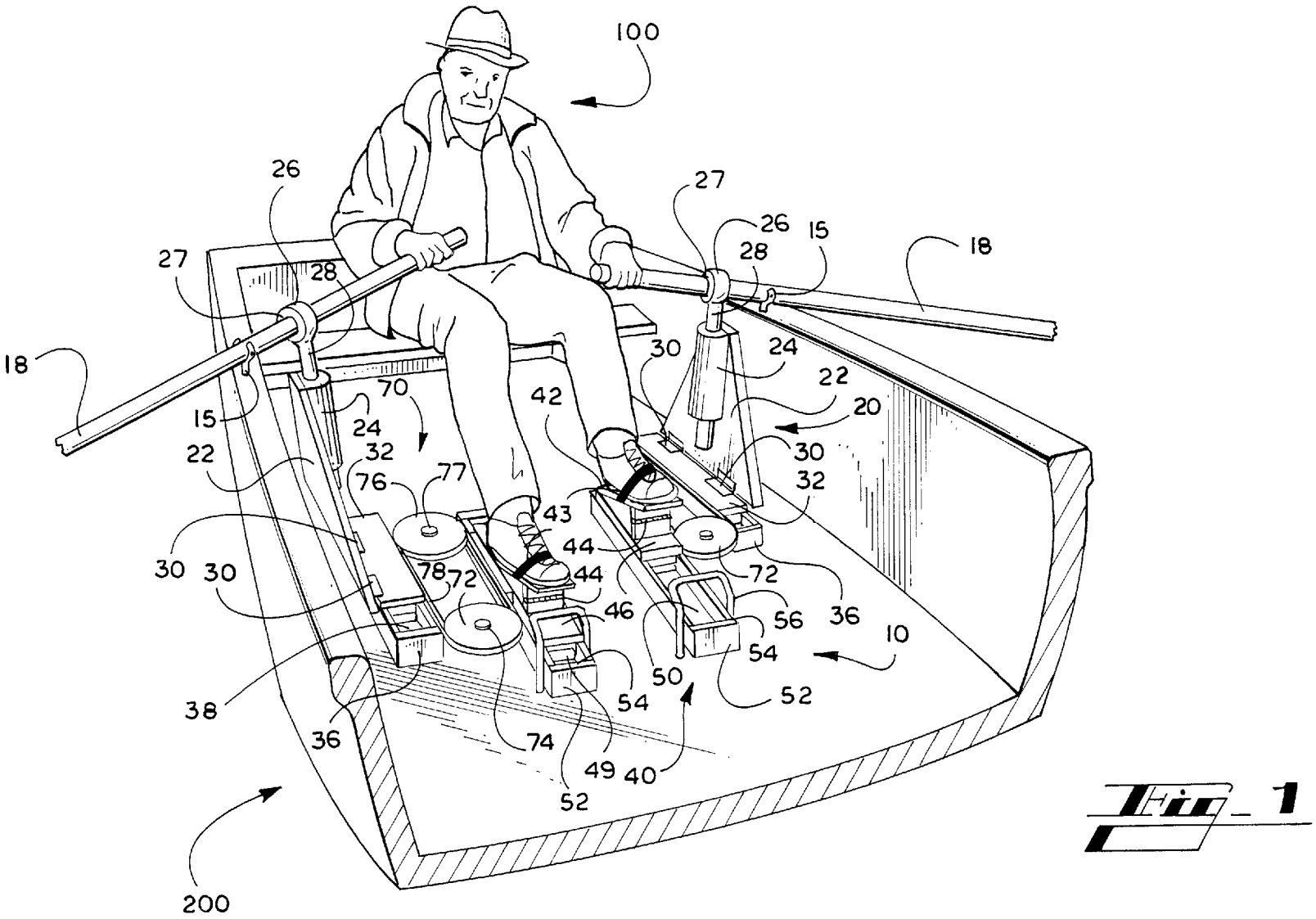
FIG. 1 is perspective view of a preferred embodiment of the present invention attached to, and in operation with, a row boat shown in partial section.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. There is shown a preferred embodiment of the present invention, indicated generally by reference numeral 10, attached to and in operation with a row boat 200. Generally, device 10 comprises preferably oar mechanism 20, foot glide mechanism 40 and force transfer mechanism 70.

Figure 2:
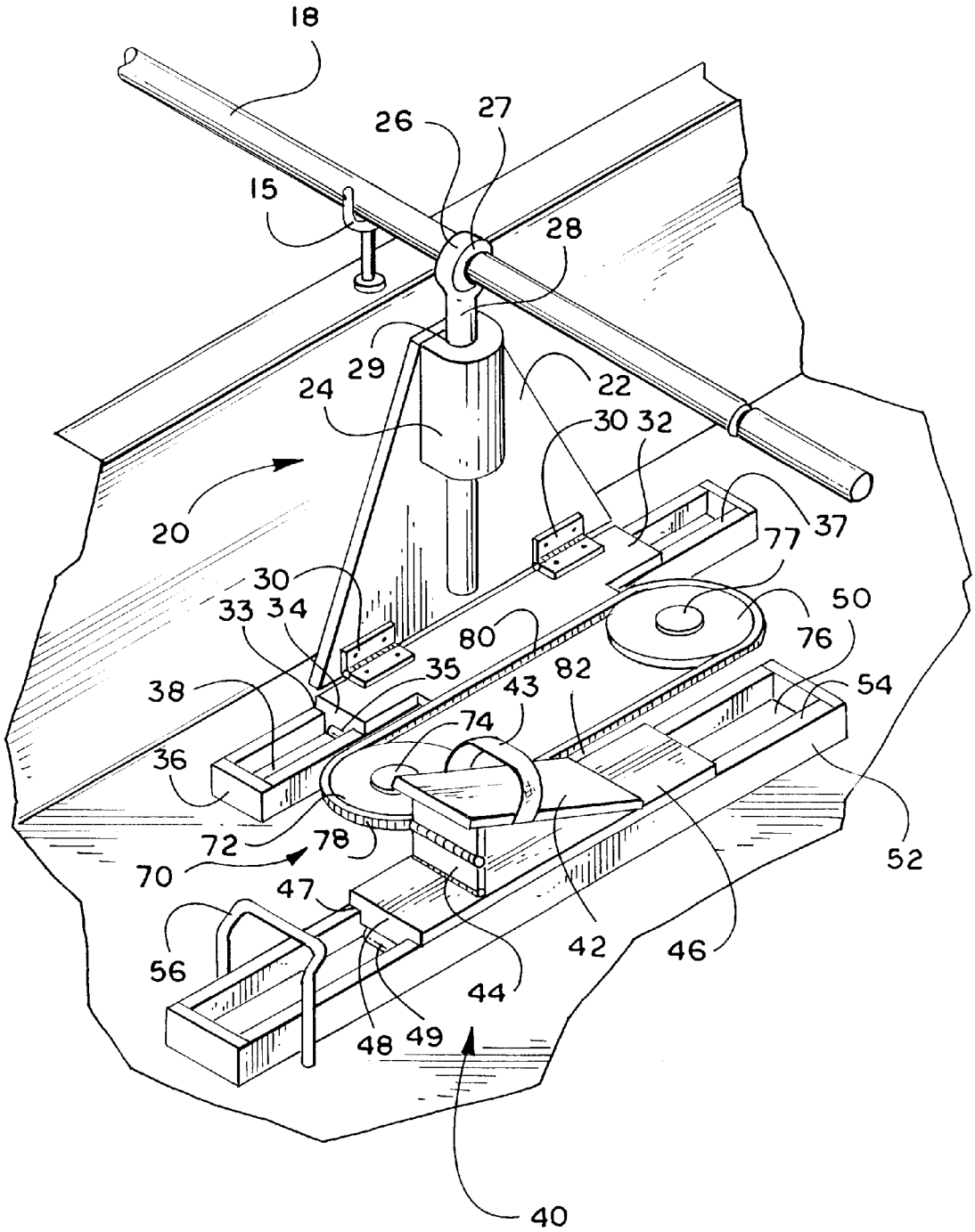
FIG. 2 is a partial perspective view of one side of a preferred embodiment of the present invention.
Figure 3:
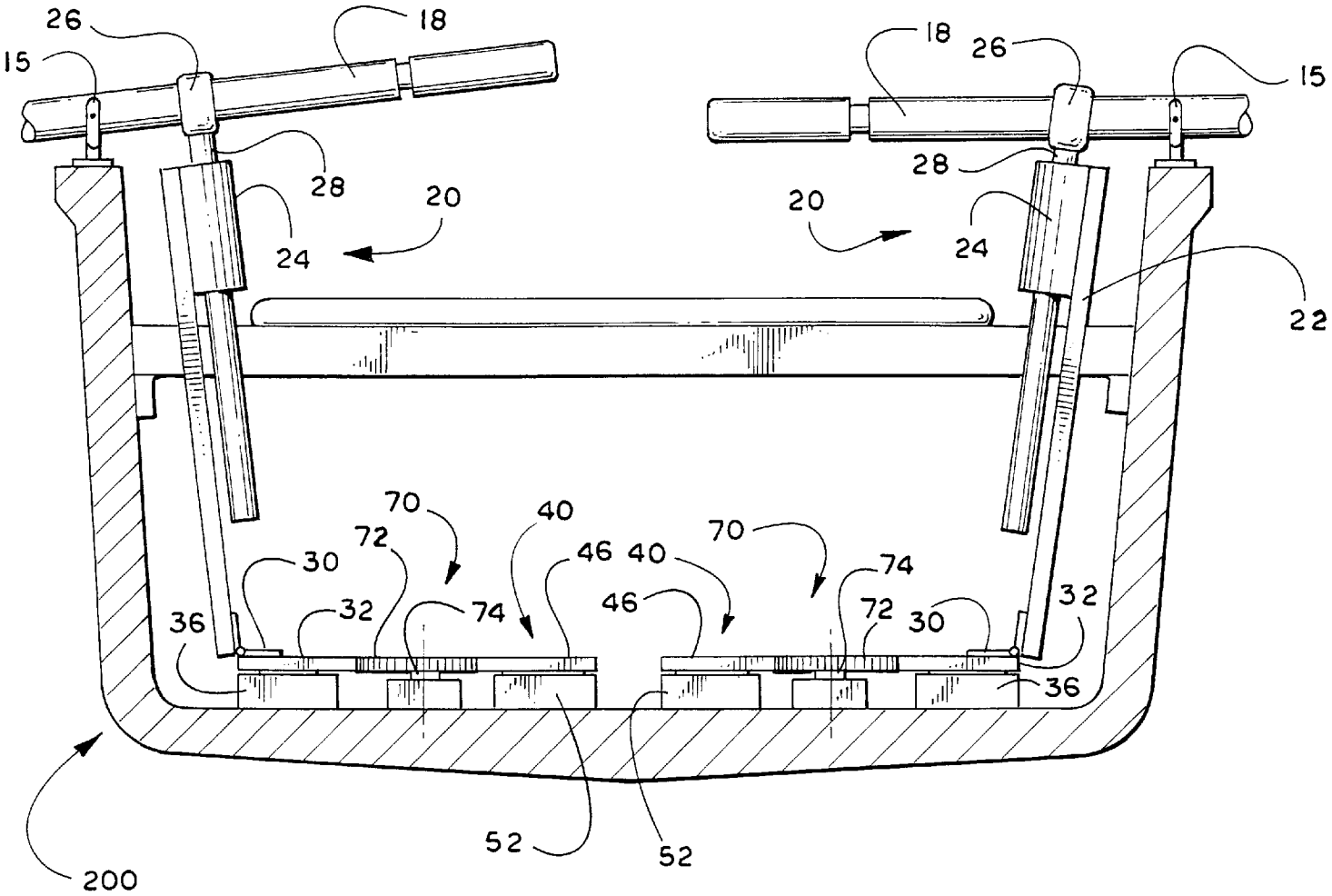
FIG. 3 is a front elevation view of a preferred embodiment of the present invention.

More specifically, now referring to FIG. 2, oar mechanism 20 comprises preferably triangular support member 22, oar lock stem support 24, oar lock 26, filler material 27, oar lock stem 28, hinges 30, oar glide member 32 and track member 36. Track member 36 is secured to the floor of a boat 200, and oar glide member 32 is designed to slide forwards and backwards within track member 36. More specifically, in a preferred embodiment, track member 36 is generally elongated-box shaped with the top removed, thereby forming channel 38. Oar glide member 32 is generally an elongated rectangular member having a lower reduced width portion 34 that is dimensioned to be received within channel 38 of track member 36. The width of the upper portion of oar glide member 32 is approximately equivalent to the width of track member 36. Thus, the L-shaped shoulder 33 formed between the upper and lower portions of oar glide member 32 rest upon upper ledge 37 of track member 36. In order to reduce the friction between oar glide member 32 and track member 36 and to facilitate the sliding of oar glide member 32 within track member 36, a plurality of rollers 35 are attached to the bottom surface of reduced width portion 34 of oar glide member 32 and generally extend the length thereof. Reduced width portion 34 may be extended lower or the diameter of rollers 35 may be enlarged to slightly raise L-shaped shoulder 33 off of upper ledge 37, thereby further reducing frictional force and further facilitating the sliding of oar glide member 32.

Hinged to the upper surface and generally near the outer edge of oar glide member 32 by hinges 30 is triangular support member 22. Attached to triangular support member 22 is generally half cylindrically shaped oar lock stem support 24. Bored through oar lock stem support 24 is vertically positioned throughhole 29 dimensioned for receiving oar lock stem 28. Oar lock stem 28 is, preferably, an elongated rod having oar lock 26 formed at its upper end. Additionally, oar lock stem 28 can slide vertically within oar lock stem support 24. In an alternate embodiment, a stop screw or end cap may be installed on the end of oar lock stem 28 opposite oar lock 26 to prevent oar lock stem 28 from being raised out of oar lock stem support 24 during operation.

Oar lock 26 is dimensioned for receiving the cylindrical portion of oar 18. However, the inner diameter of oar lock 26 is preferably slightly larger than the diameter of the cylindrical portion of oar 18 so as to allow restricted movement of oar 18 while inserted through oar lock 26. To further limit the movement of the oar 18 within the oar lock 26 and provide more control to the movement of oar 18 within oar lock 26, donut shaped filler material 27, such as rubber, nylon, Teflon® or other low friction flexible material, having an inner diameter approximately equal to the diameter of oar 18, is secured within oar lock 27, thereby allowing oar 18 to have limited pivotability within oar lock 26.

Foot glide mechanism 40 comprises, generally, foot rest 42, strap 43, spring hinge 44, foot glide member 46, foot track member 52 and hinge release 56. Similar to track member 36 and oar glide member 32 of oar movement mechanism 20, foot track member 52 is secured to the floor of a boat 200, and foot glide member 46 is designed to slide forwards and backwards within foot track member 52. More specifically, in a preferred embodiment, foot track member 52 is generally elongated-box shaped with the top removed, thereby forming channel 50. Foot glide member46 is generally an elongated rectangular member having a lower reduced width portion 48 that is dimensioned to be received within channel 50 of foot track member 52. The width of the upper portion of foot glide member 46 is approximately equivalent to the width of foot track member 52. Thus, the L-shaped shoulder 47 formed between the upper and lower portions of foot glide member 46 rest upon upper ledge 54 of foot track member 52. In order to reduce the friction between foot glide member 46 and foot track member 52 and to facilitate the sliding of foot glide member 46 within foot track member 52, a plurality of rollers 49 are attached to the bottom surface of reduced width portion 48 of foot glide member 46 and generally extend the length thereof. Reduced width portion 48 may be extended lower or the diameter of rollers 49 may be enlarged to slightly raise L-shaped shoulder 47 off of upper ledge 54, thereby further reducing frictional force and further facilitating the sliding of foot glide member 46. Or, alternatively, the bottom of foot glide member 46 and the slightly raised L-shaped shoulder 47 could be lined with Teflon®, nylon or some other flexible friction reducing composition.

Secured by spring hinge 44 to the upper surface of foot glide member 46, generally near the front, is foot rest 42. Foot rest 42 is generally rectangularly shaped and is of sufficient size to rest a foot upon. Strap 43 is attached to foot rest 42 to assist in securing the operator's 100 foot thereon. Spring hinge 44 urges the front portion of foot rest 42 in the upward direction and is of sufficient length to place foot rest 42 at an angle less than 90 degrees from foot glide member 46. Additionally, when spring hinge 44 is fully extended, the movement of the respective portions of spring hinge 44 is limited such that spring hinge 44 will not hinge any further in the direction spring hinge 44 urges foot rest 42, thus locking foot rest 42 at the angle of full extension of spring hinge 44. Positioned near the front of and outside of channel 50 of foot track member 52 is generally inverted U-shaped hinge release 56. Hinge release 56 may be secured to foot track member 52 or to the floor of boat 200. Preferably, the upper portion of hinge release 56 is angled toward the distal end of foot track member 52 and is positioned at the height generally level with the center of spring hinge 44 when fully extended. In the initial state, foot glide member 46 is positioned at the rear of foot track member 52 and spring hinge 44 is fully extended thereby placing foot rest 42 at an angle less than 90 degrees. As the operator 100 presses his foot upon foot rest 42 thus sliding foot glide member 46 forward within foot track member 52, generally the center of spring hinge 44 contacts hinge release 56 thereby forcing spring hinge 44 to release from its locked position and hinge outward thus lowering foot rest 42 to a generally horizontal position. Foot rest 42 stays in this generally horizontal position while the operator slides his foot back toward himself. Once he reaches the rear of foot track member 52, he slightly raises his foot thereby allowing spring hinge 44 to urge the front of foot rest 42 upward until spring hinge 44 is once again locked in its extended position.

In order to transfer the force between foot glide mechanism 40 to oar movement mechanism 20, force transfer mechanism 70 is positioned therebetween and engages both oar glide member 32 and foot glide member 46. Force transfer mechanism 70 comprises generally first pulley 72, second pulley 76, first axle 74, second axle 77 and drive belt 78. More specifically, first axle 74 and second axle 77 are secured to the floor of boat 200 generally an equal distance between oar glide member 32 and foot glide member 46 and a distance apart. Rotatably attached to first axle 74 and second axle 77 are first pulley 72 and second pulley 76, respectively. Linking and surrounding first pulley 72 and second pulley 76 is a continuous loop drive belt 78. The diameters of first pulley 72 and second pulley 76 are dimensioned such that when drive belt 78 is in position, drive belt 78 engages oar glide member 32 and foot glide member 46.

It is noted that the opposite side of boat 200 is a mirror image of the side just described and comprises all identical components and operates in the same manner. However, each side moves independent of the other side to facilitate the turning of boat 200.

In use, when operator 100 presses his feet forward foot glide member 46 will slide forward within channel 50 of foot track member 52 thereby moving drive belt 78, first pulley 72 and second pulley 76 in the clockwise direction. As a result, the clockwise rotation of drive belt 78 forces oar glide member 32 to the aft of boat 200. Thus, oar 18 connected via oar lock 26, oar lock stem 28, oar lock stem support 24 and triangular support member 22 will also be forced in the aft direction. When spring hinge 44 contacts hinge release 56, hinge 44 will unlock and foot rest 42 will lower. At the same time, the operator 100 raises oars 18 out of the water and pulls his feet back toward himself thus resulting in drive belt 78 rotating in the counterclockwise direction. This counterclockwise rotation results in oar movement mechanism 20 being advanced to its forward position. Additionally, because of the oar's freedom of movement allowed by the present invention 10 via hinges 30, vertically sliding oar lock stem 28 and oar lock filler material 27, oars 18 can be mechanically advantaged yet its movement remain substantially natural.

Having thus described exemplary embodiments of the present invention, it should be noted by those skilled in the art that the within disclosures are exemplary only and that various other alternatives, adaptations, and modifications may be made within the scope of the present invention. For instance, hinges 30 may consist of any number of hinges or may be other suitable hinge means. Additionally, triangular support member 22 may be of various shapes and sizes, not necessarily triangular shape. Drive belt 78 may be a chain or a plurality of gears engaging the respective components, and/or the respective components may have grooves or teeth for assisting the engagement thereof.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A leg assisted forward rowing system for use on a boat having oars, comprising:

means for receiving at least one foot of a user;

first means attached to the boat for slidably engaging said foot receiving means, said first slidably engaging means having a distal end and a proximal end, wherein said foot receiving means slides forward toward said distal end and rearward toward said proximal end within said first slidably engaging means when the user applies a forward and rearward force, respectively, to at least one of the user's feet;

means for receiving the oars of the boat;

second means attached to the boat for slidably engaging said oar receiving means, said second slidably engaging means having a distal end and a proximal end; and means for inversely transferring said forward and rearward movement of said foot receiving means to said oar receiving means, wherein the user applies a forward force with at least one of his feet to said foot receiving means thereby causing said foot receiving means to slide forward within said first slidably engaging means and said inverse transferring means forces said oar receiving means to slide rearward within said second slidably engaging means, and wherein the user applies a rearward force with at least one of his feet to said foot receiving means thereby causing said foot receiving means to slide rearward within said first slidably engaging means and said inverse transferring means forces said oar receiving means to slide forward within said second slidably engaging means.

2. A leg assisted forward rowing system as claimed in claim 1, wherein said foot receiving means comprises:

a first foot rest;

a sliding member, said sliding member dimensioned to be received by said first slidably engaging means; and a strap carried by said foot rest, said strap dimensioned for removably securing a foot to said foot rest, wherein said foot rest is carried by said sliding member.

3. A leg assisted forward rowing system as claimed in claim 1, wherein said foot receiving means comprises:

a foot rest having an upper surface and a lower surface, said upper surface and said lower surface having a front portion and a rear portion;

a sliding member having an upper surface and a lower surface, said lower surface of said sliding member dimensioned to be received by said first slidably engaging means;

a releasable locking means having a locked position, said releasable locking means carried between said lower surface of said foot rest and said upper surface of said sliding member at said front portion of said lower surface of said foot rest, wherein when said releasable locking means is in said locked position said front portion of said lower surface of said foot rest is raised from said sliding member;

means for unlocking said releasable locking means carried by said boat, wherein said unlocking means unlocks said releasable locking means after said sliding member is slid forward a distance within said first slidably engaging means thereby allowing said foot rest to lower on said rearward movement of said foot rest and wherein said releasable locking means again locks in said locking position when said foot rest is again slid forward; and a strap carried by said foot rest, said strap dimensioned for removably securing a foot to said foot rest.

4. A leg assisted forward rowing system as claimed in claim 3, wherein said releasable locking means is a releasable locking spring hinge having a first member and a second member pivotably connected about said releasable locking spring hinge;

said releasable locking spring hinge having a locked position;

said first member and said second member having a first side and a second side, wherein when said releasable locking spring hinge is in said locked position, said first side of said first member is generally parallel and in line with said first side of said second member;

said pivotability of said first member and said second member about said releasable locking spring hinge is restricted such that said second side of said first member is allowed to pivot towards said second side of said second member until said locked position is reached; and wherein said unlocking means is an inverted U-shaped member positioned near said distal end of said first slidably engaging means, said inverted U-shaped member contacts said releasable locking spring hinge when said foot rest is slid to said distal end of said first slidably engaging means thereby pushing said releasable locking spring hinge backwards and forcing said first side of said first member to pivot toward said first side of said second member and thus collapsing said releasable locking spring hinge from said locked position.

5. A leg assisted forward rowing system as claimed in claim 1, wherein said first slidably engaging means comprises:

a first elongated side wall having a distal end and a proximal end;

a second elongated side wall having a distal end and a proximal end;

a front wall connecting said distal end of said first elongated side wall with said distal end of said second elongated side wall;

a rear wall connecting said proximal end of said first elongated side wall with said proximal end of said second elongated side wall; and a bottom wall connecting said first elongated side wall, said second elongated side wall, said front wall and said rear wall thereby forming an elongated trough.

6. A leg assisted forward rowing system as claimed in claim 1, wherein said oar receiving means comprises:

an oar lock dimensioned for receiving the oar;

an oar lock stem attached to said oar lock and extending vertically downward from said oar lock; and a first support member dimensioned for slidably engaging said oar lock stem, wherein said oar lock stem slides vertically within said first support member and wherein said first support member is carried by said second slidably engaging means.

7. A leg assisted forward rowing system as claimed in claim 1, wherein said oar receiving means comprises:

an oar lock dimensioned for receiving the oar;

an oar lock stem attached to said oar lock and extending vertically downward from said oar lock;

a first support member dimensioned for slidably engaging said oar lock stem, wherein said oar lock stem slides vertically within said first support member;

a second support member, wherein said first support member is carried by said second support member; and a sliding member engaging said second slidably engaging means, wherein said second support member is pivotably attached to said sliding member.

8. A leg assisted forward rowing system as claimed in claim 7, wherein said second support member is triangular shaped.

9. A leg assisted forward rowing system as claimed in claim 1, wherein said second slidably engaging means comprising:

a first elongated side wall having a distal end and a proximal end;

a second elongated side wall having a distal end and a proximal end;

a front wall connecting said distal end of said first elongated side wall with said distal end of said second elongated side wall;

a rear wall connecting said proximal end of said first elongated side wall with said proximal end of said second elongated side wall; and a bottom wall connecting said first elongated side wall, said second elongated side wall, said front wall and said rear wall thereby forming an elongated trough.

10. A leg assisted forward rowing system as claimed in claim 1, wherein said inverse transferring means comprises:

a first pulley rotatably attached to the boat horizontally between said first slidably engaging means and said second slidably engaging means and near said proximal end of said first slidably engaging means and said proximal end of said second slidably engaging means;

a second pulley rotatably attached to the boat horizontally between said first slidably engaging means and said second slidably engaging means and near said distal end of said first slidably engaging means and said distal end of said second slidably engaging means; and means for linking said first pulley with said second pulley, wherein said first pulley rotates in the same direction as said second pulley and wherein said linking means engages said oar receiving means and said foot receiving means.

11. A leg assisted forward rowing system as claimed in claim 10, wherein said linking means is a belt wrapped around said first pulley and said second pulley wherein said belt forms an elliptical pattern.

12. A leg assisted forward rowing system as claimed in claim 10, wherein said linking means is a chain wrapped around said first pulley and said second pulley wherein said chain forms an elliptical pattern.

13. A leg assisted forward rowing system for use on a boat having a first oar and a second oar, comprising:

first means for receiving first foot of a user;

second means for receiving a second foot of a user;

first means attached to the boat for slidably engaging said first foot receiving means, said first slidably engaging means having a distal end and a proximal end, wherein said first foot receiving means slides forward toward said distal end and rearward toward said proximal end within said first slidably engaging means when the user applies a forward and rearward force, respectively, to user's first foot;

second means attached to the boat for slidably engaging said second foot receiving means, said second slidably engaging means having a distal end and a proximal end, wherein said second foot receiving means slides forward toward said distal end and rearward toward said proximal end within said second slidably engaging means when the user applies a forward and rearward force, respectively, to user's second foot;

first means for receiving the first oar of the boat;

second means for receiving the second oar of the boat;

third means attached to the boat for slidably engaging said first oar receiving means, said third slidably engaging means having a distal end and a proximal end;

fourth means attached to the boat for slidably engaging said second oar receiving means, said fourth slidably engaging means having a distal end and a proximal end;

first means for inversely transferring said forward and rearward movement of said first foot receiving means to said first oar receiving means, wherein the user applies a forward force with user's first foot to said first foot receiving means thereby causing said first foot receiving means to slide forward within said first slidably engaging means and said first inverse transferring means forces said first oar receiving means to slide rearward within said third slidably engaging means, and wherein the user applies a rearward force with user's first foot to said first foot receiving means thereby causing said first foot receiving means to slide rearward within said first slidably engaging means and said first inverse transferring means forces said first oar receiving means to slide forward within said third slidably engaging means; and second means for inversely transferring said for ward and rearward movement of said second foot receiving means to said second oar receiving means, wherein the user applies a forward force with user's second foot to said second foot receiving means thereby causing said second foot receiving means to slide forward within said second slidably engaging means and said second inverse transferring means forces said second oar receiving means to slide rearward within said fourth slidably engaging means, and wherein the user applies a rearward force with user's second foot to said second foot receiving means thereby causing said second foot receiving means to slide rearward within said second slidably engaging means and said second inverse transferring means forces said second oar receiving means to slide forward within said fourth slidably engaging means.

* * * * *